US010980341B1

(12) United States Patent
Van Pelt

(10) Patent No.: US 10,980,341 B1
(45) Date of Patent: Apr. 20, 2021

(54) BEVERAGE RACK ASSEMBLY AND METHOD OF CONSTRUCTION

(71) Applicant: Gregory Allan Van Pelt, Marysville, WA (US)

(72) Inventor: Gregory Allan Van Pelt, Marysville, WA (US)

( * ) Notice: Subject to any disclaimer, the term of this patent is extended or adjusted under 35 U.S.C. 154(b) by 0 days.

(21) Appl. No.: 16/940,345

(22) Filed: Jul. 27, 2020

(51) Int. Cl.
*A47B 73/00* (2006.01)
*A47B 47/00* (2006.01)

(52) U.S. Cl.
CPC ..... *A47B 73/006* (2013.01); *A47B 47/0091* (2013.01); *A47B 73/00* (2013.01)

(58) Field of Classification Search
CPC ... A47B 73/00; A47B 73/006; A47B 47/0091; A47B 73/002; A47B 73/008; A47B 47/047; A47B 47/028; A47B 47/0025; A47B 87/007; A47B 47/042
USPC ..... 211/74
See application file for complete search history.

(56) References Cited

U.S. PATENT DOCUMENTS 2,622,741 A * 12/1952 Bamert ..... A47B 73/00 211/74
3,891,335 A * 6/1975 Feil ..... F16B 5/0614 403/173
4,023,681 A * 5/1977 Plant ..... A47B 47/042 211/74
D268,463 S * 4/1983 Olson ..... D7/708
D292,657 S * 11/1987 Wightman ..... D7/701
4,715,503 A * 12/1987 Johnson ..... A47B 47/04 211/189
4,825,620 A * 5/1989 Johnson ..... A47B 47/04 211/189
D312,362 S * 11/1990 Wightman ..... D6/682.2
4,969,568 A * 11/1990 Yoshida ..... B43M 99/008 211/186
D317,991 S * 7/1991 Wightman ..... D7/708
5,185,982 A * 2/1993 Hostetler ..... F16B 7/044 211/189

(Continued)

FOREIGN PATENT DOCUMENTS

EP 0980656 * 8/1999 ..... A47B 73/006

OTHER PUBLICATIONS

"Assembly Instructions Cellar Trellis Wine Rack," downloaded from https://www.vinotemp.com/12-bottle-cellar-trellis-wine-rack on Jul. 23, 2020.

*Primary Examiner* — Jonathan Liu
*Assistant Examiner* — Devin K Barnett
(74) *Attorney, Agent, or Firm* — Leonid Kisselev

(57) ABSTRACT

A beverage rack assembly is provided that is lightweight, easy to assemble and disassemble, and can be set in multiple orientations to accommodate various environments. The rack assembly includes two lattices that are made out of sticks coupled to each other at slots in the sticks. The lattices are joined together by risers that include two ends, each of the ends including four appendages shaped as triangular-prisms, and that attach to the two lattices at each of the stick couplings. Portions of the sticks that extend beyond the terminal couplings together form support structures on multiple sides of the rack that allow the rack to be set at various orientations. The rack is made out lightweight materials, such as wood or plastic, further contributing to the portability of the rack and the rack's components.

17 Claims, 7 Drawing Sheets

(56) References Cited

U.S. PATENT DOCUMENTS 5,197,612 A * 3/1993 Thomson ..... A47B 73/004 211/74
5,947,305 A * 9/1999 Lin ..... A47B 73/006 211/74
6,615,999 B1 * 9/2003 Culp ..... A47B 47/042 211/184
6,845,871 B1 * 1/2005 Culp ..... A47B 47/042 211/184
7,114,300 B1 * 10/2006 Culp ..... A47B 47/042 52/211
7,604,133 B2 * 10/2009 Tsai ..... A47B 73/006 211/189
7,963,404 B2 * 6/2011 Shang ..... A47F 7/08 211/36
8,248,792 B2 * 8/2012 Wei ..... H05K 7/20745 361/692
8,302,363 B1 * 11/2012 Johnson ..... E04H 6/025 52/655.1
8,662,326 B2 * 3/2014 Brick ..... A47B 47/042 211/186
2003/0080073 A1 * 5/2003 Huang ..... A47B 43/00 211/40
2003/0205543 A1 * 11/2003 Kao ..... A47B 73/002 211/74
2007/0108145 A1 * 5/2007 Milardo ..... A47B 73/00 211/74
2011/0049068 A1 * 3/2011 Potter ..... A47B 73/00 211/69.1
2012/0187813 A1 * 7/2012 Plunkett ..... A47B 73/00 312/240
2012/0294675 A1 * 11/2012 Chang ..... A47B 47/0016 403/354
2013/0292351 A1 * 11/2013 Wyatt ..... A47B 87/007 211/188
2013/0341295 A1 * 12/2013 Dixon ..... A47B 81/007 211/74
2015/0076091 A1 * 3/2015 Lee ..... A47B 73/006 211/85.4
2015/0076099 A1 * 3/2015 Chang ..... A47B 55/02 211/186
2015/0096954 A1 * 4/2015 Liu ..... A47B 47/0025 211/186
2016/0120307 A1 * 5/2016 Salani ..... B65D 25/54 206/776
2018/0058624 A1 * 3/2018 McPhillips ..... F16B 9/02
2018/0064248 A1 * 3/2018 Mederata ..... A47B 96/021
2018/0146776 A1 * 5/2018 Lye ..... A47B 47/0091
2019/0082831 A1 * 3/2019 Smith ..... A47F 7/281
2020/0187651 A1 * 6/2020 Schlanger ..... A47B 47/047

* cited by examiner

BEVERAGE RACK ASSEMBLY AND METHOD OF CONSTRUCTION

FIELD

The present invention relates in general to shelving, and in particular, to a beverage rack assembly and a method of construction.

BACKGROUND

Alcoholic beverages, such as wine, can spend a long time in bottles before they are consumed. Some wines, such as certain sparkling wines, undergo secondary fermentation while inside the bottles even before they are sold to consumers. Even when ready for consumption, some wine bottles, especially of fine wines, are stored for an extended period of time prior to being consumed to allow for long-term aging processes to occur. Regardless of whether wine bottles are stored during the winemaking process, after the winemaking process is complete but before being sold to consumers, or by consumers, as the bottles are highly breakable, storing them requires an arrangement that both holds the bottles in a fixed, secure, position and does not occupy an exorbitant amount of space. Accordingly, wine makers, wine sellers, and wine consumers turn to wine racks for storage of wine bottles, especially large quantities of such bottles. Such wine racks generally include a set of shelves that maintain bottles in particular positions when the bottles are inserted into the shelves.

While useful for safely storing large numbers of wine bottles, existing wine racks come with a number of drawbacks. In particular, especially large wine racks designed to hold a large number of bottles, are difficult to transport. Further, due to their size and shape, they can be difficult to move even within a single building, requiring multiple people to maneuver them through doorways. Such large racks also tend to be heavy, further complicating the task of transporting them, even within a single building. Similarly, transporting large wine racks over long distances can require a dedicated truck that is both large enough to fit the rack and has a powerful enough engine to move the weight of the rack. In addition, such racks are generally useful only when positioned in a particular orientation, requiring a dedicated and fixed amount of space in a room for their storage.

Efforts have been made to make wine racks more portable, but such efforts have not been adequate so far. For example, Vinotemp® 12-Bottle Trellis Wine Rack, manufactured by Vinotemp International, Inc. of Rancho Dominguez, Calif., has a capacity of 12 bottles. The rack is assembled by initially combining several metal strips with notches into a partial trellis, inserting dowels into the partially completed metal trellis, completing the trellis with addition of more metal strips, and inserting additional dowels into the metal strips. Subsequently, additional metal strips that do not have any notches are placed on ends of the dowels opposite to the ends which are inserted into the trellis, and are secured into the dowels with nails that are hammered into pre-made holes in the dowels. The overall shape of the rack is a cube, meaning that the rack occupies the same amount of space regardless of how the rack is positioned, limiting where the rack can be positioned. Further, the use of nails makes a safe disassembly of such a rack problematic, if it all possible, meaning that the rack may still be too bulky to be transported by a single person in certain situations. Further, the use of metal strips increases the weight of such a rack, further decreasing the rack's portability.

Accordingly, there is a need for a beverage rack that is portable, easy to assemble and disassemble, and that can be effectively used when positioned in multiple orientations.

SUMMARY

A beverage rack assembly is provided that is lightweight, easy to assemble and disassemble, and can be set in multiple orientations to accommodate various environments. The rack assembly includes two lattices that are made out of sticks coupled to each other at slots in the sticks. The lattices are joined together by risers that include two ends, each of the ends including four appendages shaped as triangular-prisms, and that attach to the two lattices at each of the stick couplings. Portions of the sticks that extend beyond the terminal couplings together form support structures on multiple sides of the rack that allow the rack to be set at various orientations. The rack is made out lightweight materials, such as wood or plastic, further contributing to the portability of the rack and the rack's components.

In one embodiment, a beverage rack assembly is provided. The assembly includes: a lattice that includes multiple ones of a plurality of sticks, each of the plurality of sticks includes at least two slots, wherein each of the slots of each of the sticks in the lattice is coupled to one of the slots in another one of the sticks in the lattice; a further lattice comprising further ones of the plurality of the sticks, wherein each slot of each of the sticks in the further lattice is coupled to one of the slots in another one of the sticks in the further lattice; and a plurality of risers each including two ends, each of the ends includes four appendages that define a cross-shaped slot shaped to receive portions of two of the sticks proximate to the slots by which the two sticks are coupled, each of the risers removably attached to the lattice and to the further lattice by the two ends of that riser, wherein the risers define one or more enclosures into which at least one beverage bottle can be placed.

In a further embodiment, a method of beverage rack assembly construction is provided. A lattice is created out of multiple ones of a plurality of sticks, each of the plurality of the sticks including at least two slots, including coupling each of the slots of each of the multiple sticks to one of the slots in another one of the multiple sticks. One of two ends of plurality of risers is attached to the lattice, each of the two ends of each of the risers including four appendages that define a cross-shaped slot shaped to receive portions of two of the sticks proximate to the slots by which the two sticks are coupled. A further lattice is created out of further ones of the plurality of the sticks, including: inserting one of the further ones of the sticks into the cross-shaped slot defined on the end of each of the risers that is opposite to the end of that riser that is attached to the lattice; and inserting another one of the further ones of the sticks into the cross-shaped slot defined on of the opposite end of each of the risers so that the two sticks inserted into the cross-shaped slot of the opposite ends are coupled at the slots of the two sticks, wherein the risers define one or more enclosures into which at least one beverage bottle can be placed.

Still other embodiments of the present invention will become readily apparent to those skilled in the art from the following detailed description, wherein is described embodiments of the invention by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

DETAILED DESCRIPTION

Figure 1:
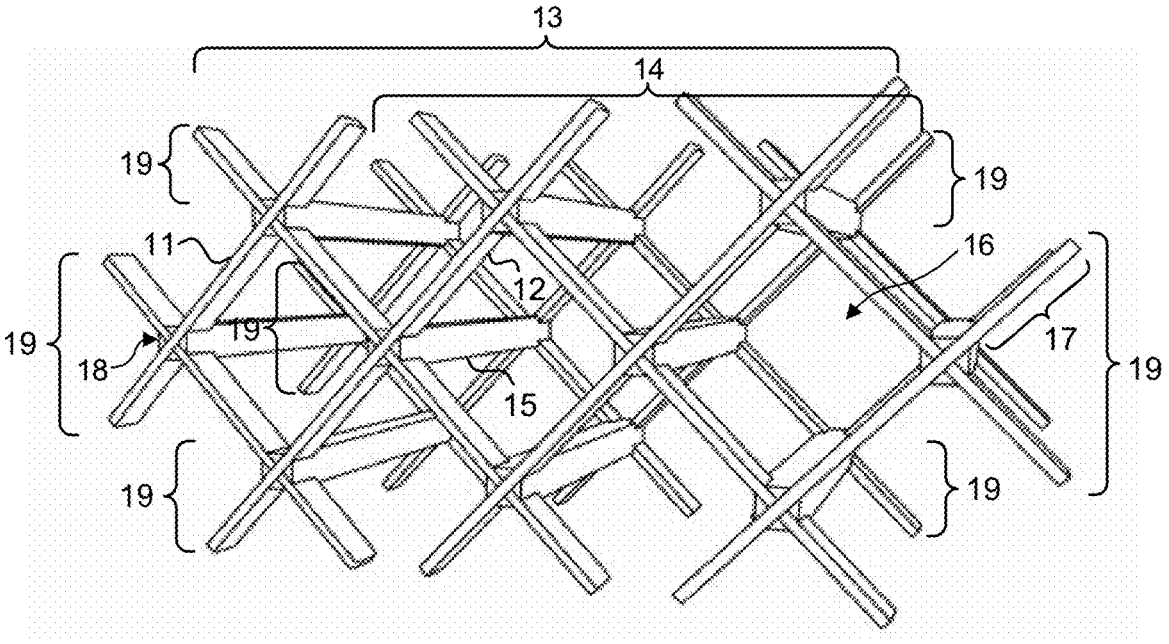
FIG. 1 shows a beverage rack assembly in accordance with one embodiment.

Portability of a beverage rack can be improved by making the rack easy to assemble and disassemble. While in the description below, the described rack is referred to as a wine rack, the described rack could also be used for storage of bottles of other alcoholic and non-alcoholic beverages. FIG. 1 shows a beverage rack assembly 10 (also referred to as "rack" in the description below) in accordance with one embodiment. The rack 10 is assembled from a plurality of sticks 11, 12 that form two lattices 13, 14, which are in turn joined together by a plurality of risers 15. The risers 15 in turn define enclosures 16 into which bottles of wine (or other beverages) can be inserted, with each enclosure 16 being defined by four of the risers 15 secured between the two lattices 13, 14. As further described below, the sticks 11, 12 in the lattices 13, 14 are coupled to each other at slots on the sticks 11, 12, with portions 17 of the sticks extending beyond the terminal couplings 18. These portions 17 form support structures 19 on which the rack 10 can be set and which contact the ground on which the rack 10 is set. As these support structures 19 are present on all sides of the racks 10, the rack 10 can be stably set horizontally or vertically, thus being able to fit into a wide variety of living or storage spaces. All of the components of the rack 10 are made out of lightweight materials, such as wood or plastic, further increasing the rack portability.

Figure 2:
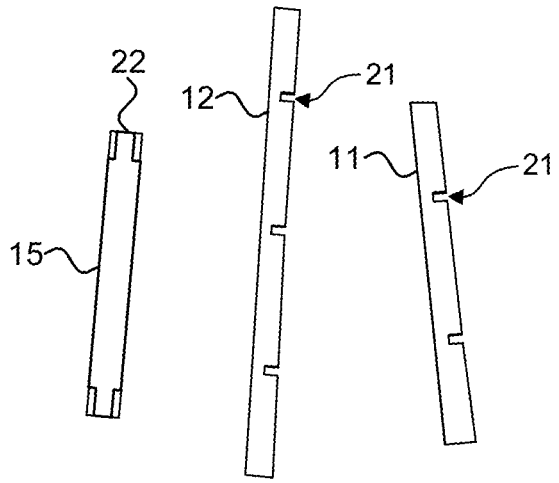
FIG. 2 is a diagram showing two sticks of different length and a riser that attaches to the coupling of those sticks in accordance with one embodiment.
Figure 7A:
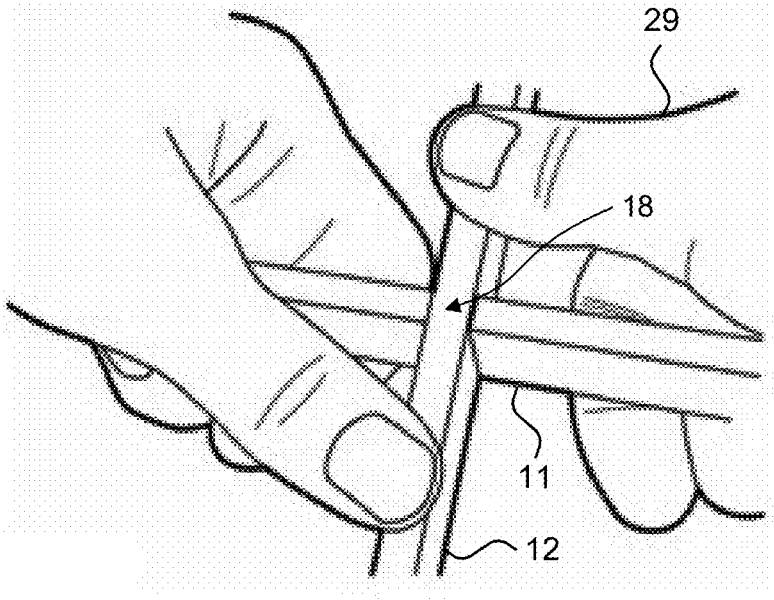
FIGS. 7A-7E are diagrams illustrating various stages of assembly of a rack in accordance with one embodiment.
Figure 7B:
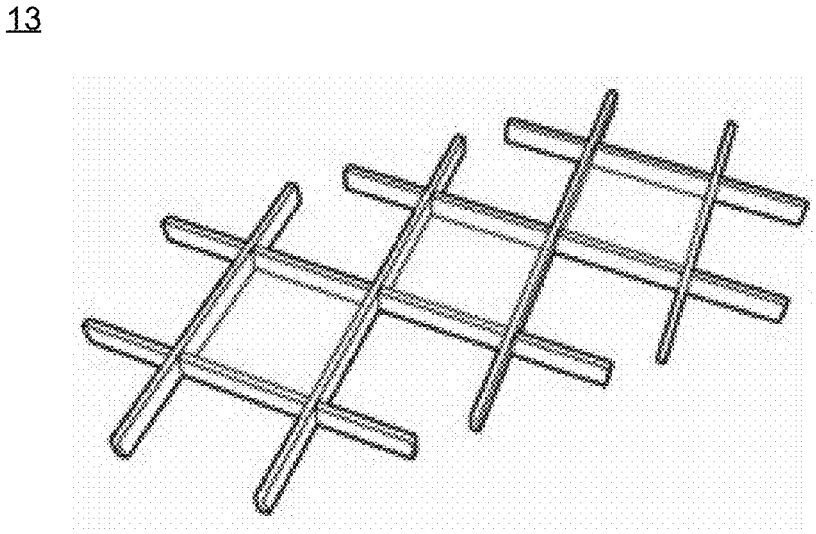
Figure 7C:
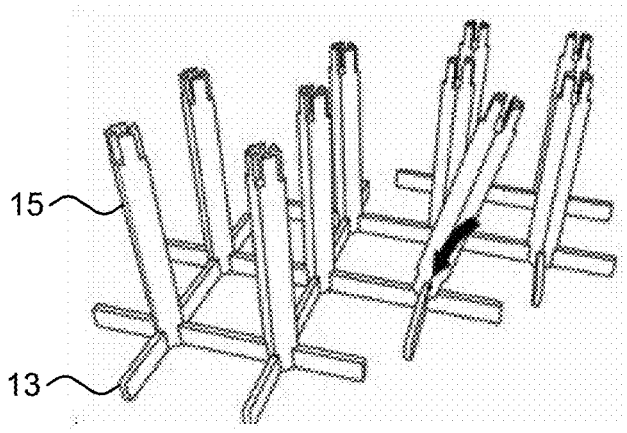
Figure 7D:
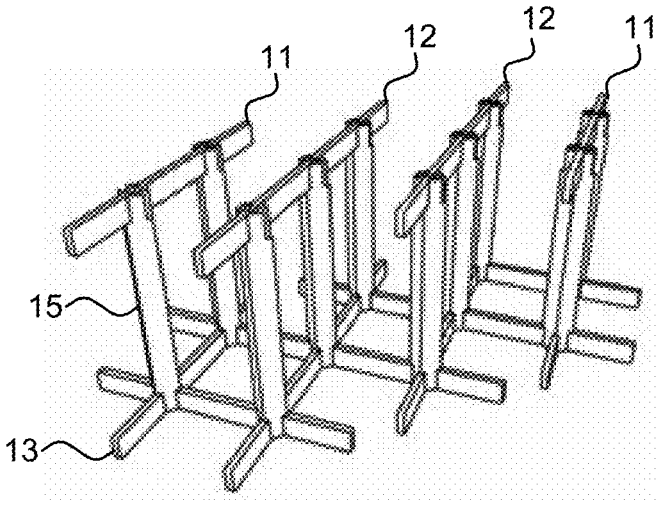
Figure 7E:
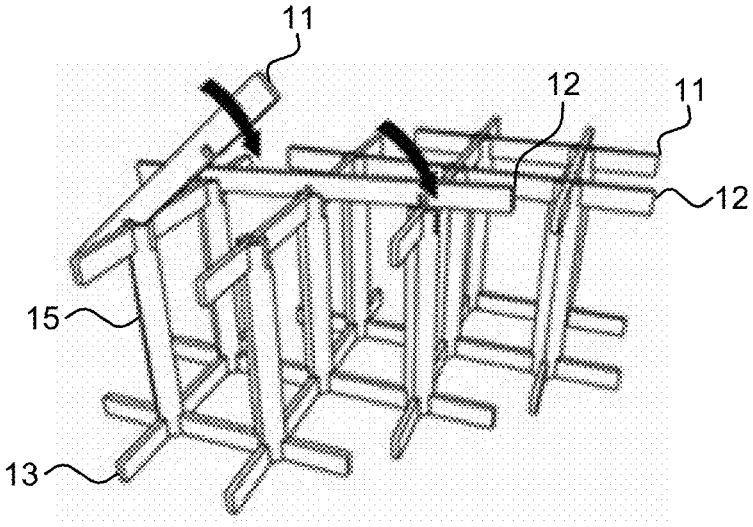

The presence of slots in the sticks allows the sticks to couple to each other and for risers 15 to attach to those couplings 18. FIG. 2 is a diagram showing two sticks 11, 12 of different length and a riser 15 that attaches to the coupling 18 of those sticks in accordance with one embodiment. The sticks 11, 12 within the same lattice 13, 14 can be of different sizes and of with different numbers of slots 21, but each stick 11, 12 includes at least two slots 21. The sticks 11, 12 in the two lattices 13, 14 are interchangeable and either of the lattices 13, 14 can be formed out of sticks 11, 12 included in the other lattice 13, 14. Despite the differences in length of the sticks 11, 12, the sizes of the slots 21 in all of the sticks are the same, allowing the sticks 12, 13 of different lengths to couple to each other. As shown with reference to FIG. 7A, the coupling 18 is formed when two of the sticks 11, 12, are positioned perpendicularly to each other, with one slot 21 on one of the sticks 11, 12 facing one slot 21 on another one of the sticks 11, 12. When pressed together, the portion of one stick 11, 12 overlying the slot 21 of that stick 11, 12 that is being coupled is secured within the slot 21 of the second stick 11, 12, and vice-versa, thus forming the coupling 18.

Figure 3:
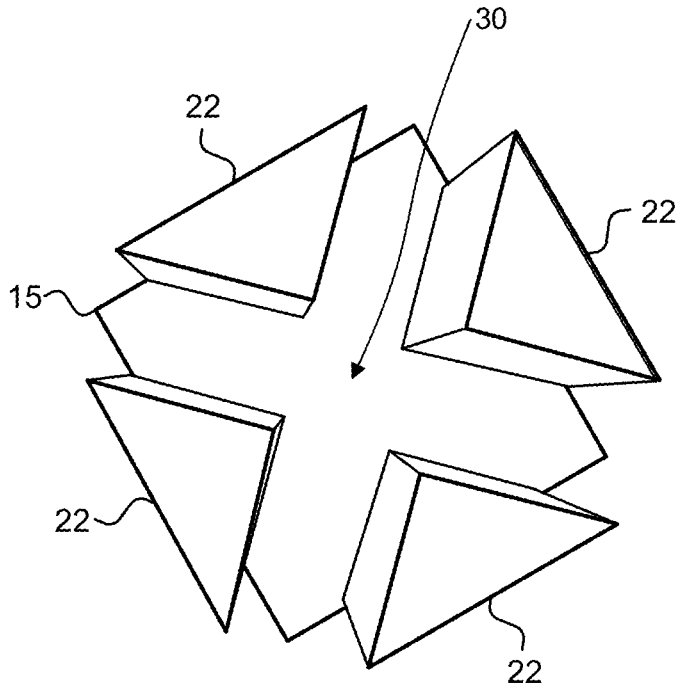
FIG. 3 is a diagram showing four appendages on one end of a riser in accordance with one embodiment.

The coupling 18 includes the portions of the sticks 11, 12 that are secured within each other's slots 21. A riser 15 removably attaches to one of the couplings 18 and portions of the sticks 11, 12 that are proximate to that couplings 18. In particular, each riser 15 includes two ends that each have four appendages 22 that trap portions of the sticks 11, 12 between them. FIG. 3 is a diagram showing four appendages 22 on one end of a riser 15 in accordance with one embodiment. The four appendages 22 are triangular-prism shaped and together they form a cross-shaped slot 30 that receives portions of two of the sticks 11, 12 proximate to the slots 21 by which the two sticks are coupled. The portions of the two sticks within the cross-shaped slots are secured between the flat sides of the triangular-prism shaped appendages 22, keeping the riser 15 securely in place. Each of the couplings 18 are thus secured within the appendages 22 of one of the risers 15, thus preventing the coupled sticks 18 from accidentally uncoupling. However, if necessary, the coupled sticks 11, 12 can be pulled out from a riser 15, and then uncoupled from each other, allowing for an easy disassembly of the rack 10. In a further embodiment, different shapes of the appendages 22 are possible.

Figure 4:
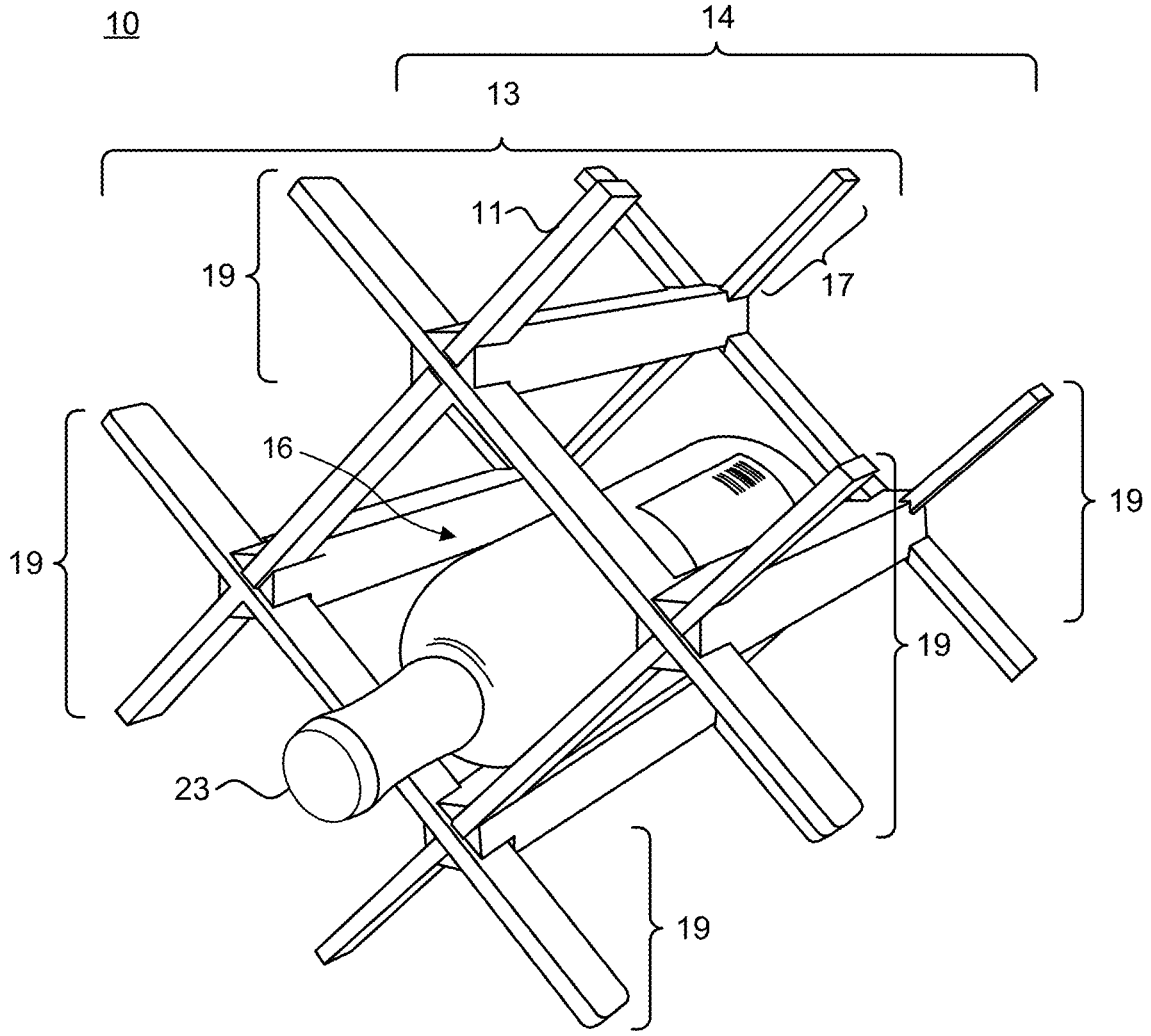
FIG. 4 is a diagram showing a rack made of sticks of the same length with a bottle inserted into the enclosure in accordance with one embodiment.

As mentioned above, the sticks 11, 12 within the same lattice 13, 14 can be of different lengths and have different numbers (both odd and even numbers) of slots 21. When sticks 11, 12 with differing numbers of slots 21 are present within a single lattice 13, 14, the number of sticks 12, 13 with each number of slots 21 within that lattice is even. Likewise, the two lattices 13, 14 within a single rack 10 have an equal number of sticks 11, 12 with each numbers of slots 21. Likewise, only sticks of the same length may be used to create one of the racks 10. FIG. 4 is a diagram showing a rack 10 made of sticks 11 of the same length with a bottle 23 inserted into the enclosure 16 in accordance with one embodiment. Each of the lattices 12, 14 is made off four sticks 11 with two slots 21 in each, with the two lattices being joined by four risers 15 that form a single enclosure 16 into which the bottle 23 is inserted. The support structures 19 on which the rack 10 can be set are identical on all sides, each support structure 19 being formed by two stick ends 17 from each of the lattices 13, 14. Thus, the rack 10 can be set on the ground on any of the four sides.

Figure 5:
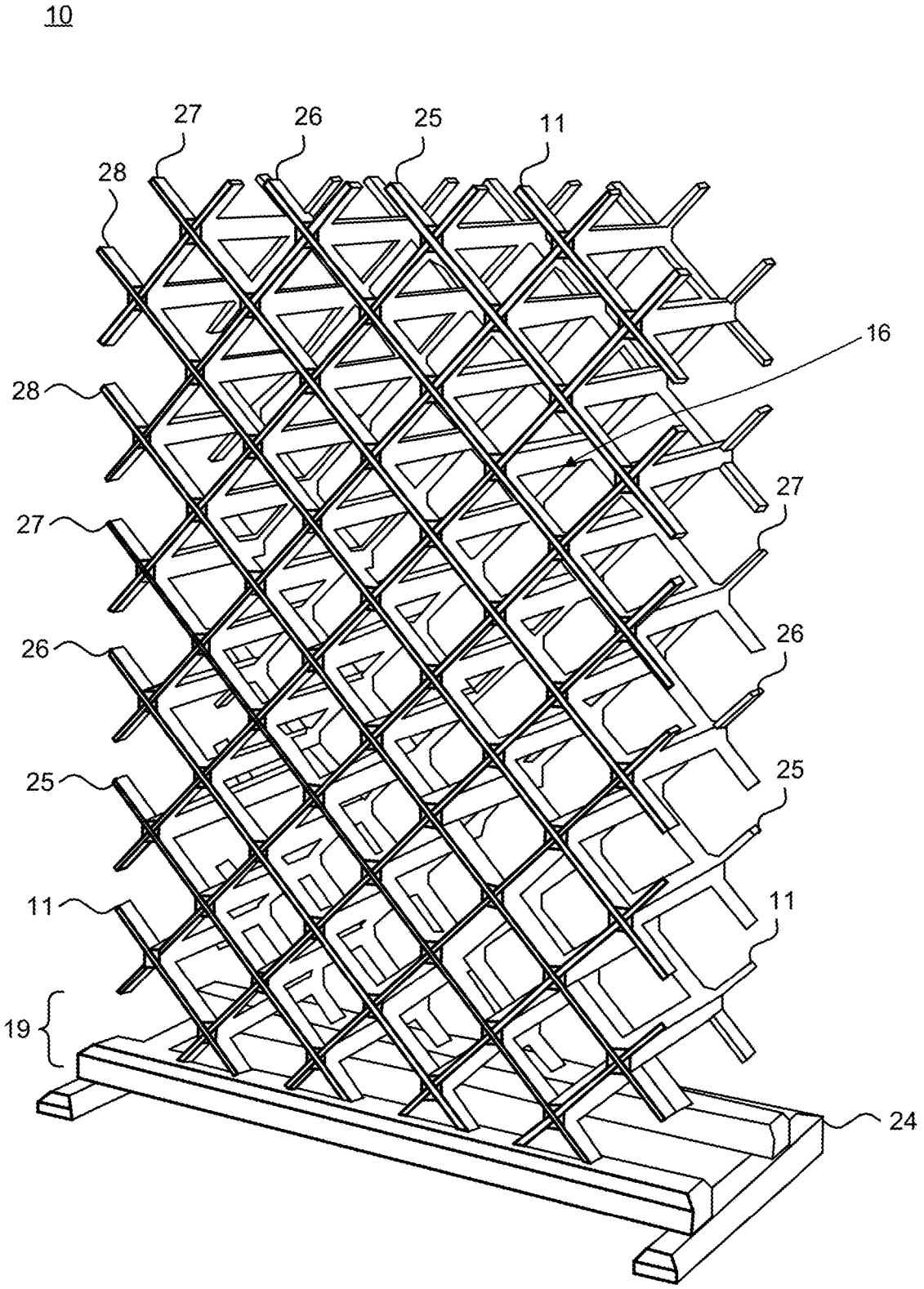
FIG. 5 is a diagram showing a rack made of sticks of four different lengths in accordance with one embodiment.

As the width of the sticks and the size of the slots 21 is the same regardless of the length of the sticks, sticks of different lengths can be coupled to each other, allowing for creation of racks 10 of different proportions. FIG. 5 is a diagram showing a rack 10 made of sticks 11, 25, 26, 27, 28 of four different lengths in accordance with one embodiment. The sticks 11, 25, 26, 27, 28 in the rack 10 includes two, four, six, eight, and nine slots 21 respectively, with all of the sticks 11, 25, 26, 27, 28 being capable of coupling with each other. By increasing the number of sticks 11, 25, 26, 27, 28 and the length of the sticks 11, 25, 26, 27, 28, a desired number of enclosures 16 can be further created. As this embodiment of the rack 10 is large, to impart more stability to the rack 10, the support structure 19 includes not only the portions 17 of the sticks extending beyond the most terminal couplings 18, but also a base 24 that is attached to those stick portions 17. With a possible exception of the sticks 11, 25, 26, 27 that connect to the base 24 (if they are fixedly attached), the rack 10 can be entirely disassembled by taking apart the risers 15 and the sticks 11, 25, 26, 27, 28, allowing to easily transport the rack 10 and then reassemble the rack 10 at a new location.

Figure 6:
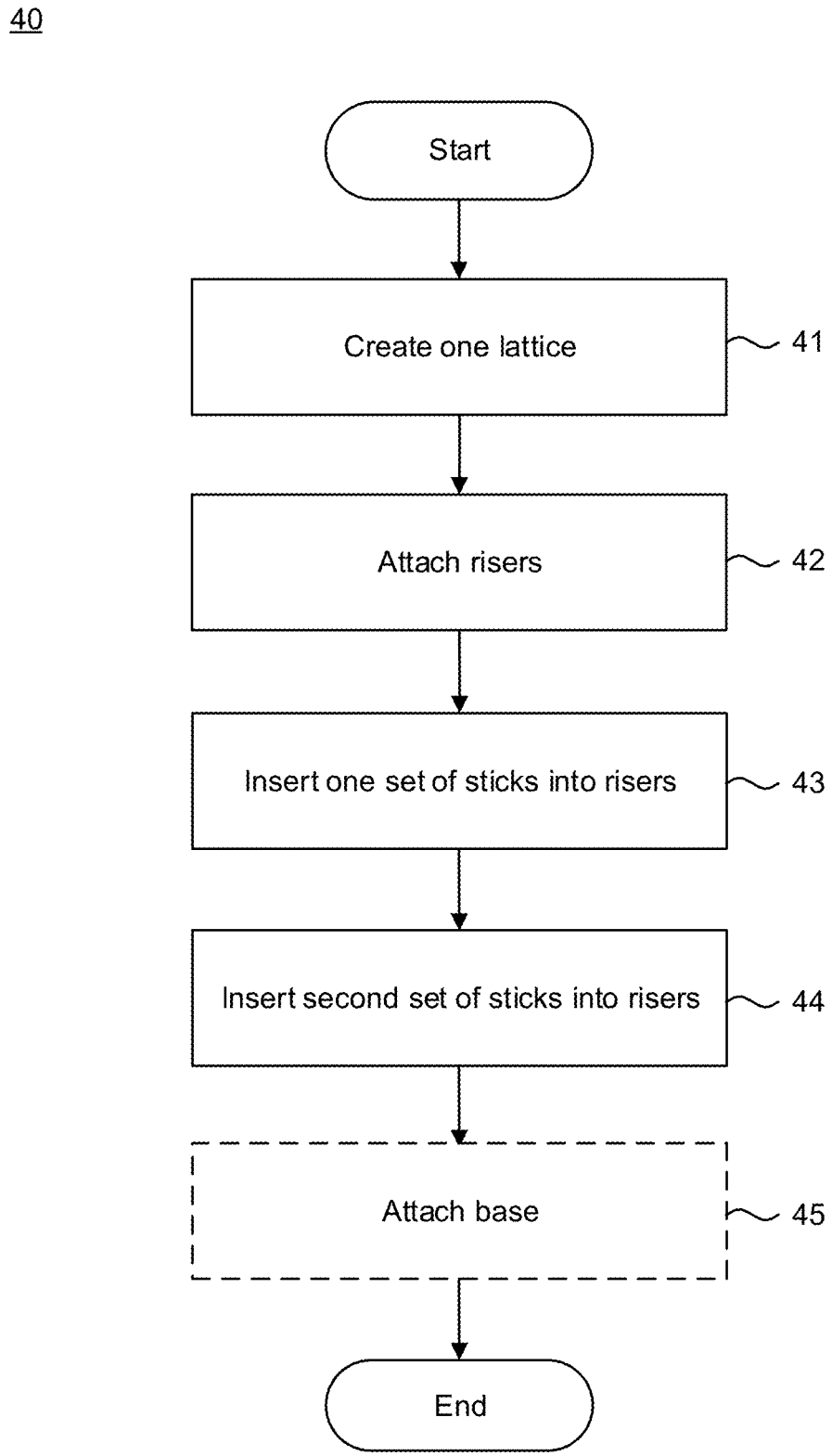
FIG. 6 is a flow diagram showing a method of construction of a beverage rack assembly in accordance with one embodiment.

Assembly and disassembly of a rack 10 can be performed without any tools, allowing a single person without any specialized skill to move a rack 10 to a desired location. FIG. 6 is a flow diagram showing a method 40 of construction of a beverage rack assembly in accordance with one embodiment. FIGS. 7A-7E are diagrams illustrating various stages of assembly of a rack 10 in accordance with one embodiment. Initially, one of the lattices 13, 14 is formed by coupling multiple sticks 11,12, 25, 26, 27, 28 together (step 41). An example of a created lattice 13, 14 is shown with reference to FIG. 7B. Two sticks 11,12, 25, 26, 27, 28 are coupled together by placing them perpendicular to each other so that the slots 21 of the two sticks 11,12, 25, 26, 27, 28 are aligned and facing each other, and then pressing onto the two sticks so that the portion of one stick 11,12, 25, 26, 27, 28 overlying that stick's slot 21 enters into the second stick's slot 21. As the sticks are perpendicular to each other, pressing the sticks 11,12, 25, 26, 27, 28 together also results in the portion of the second stick 11,12, 25, 26, 27, 28 overlying the second stick's slot entering the first stick's slot 21. The sticks 11,12, 25, 26, 27, 28 being inserted into each other's slots 21 prevents the sticks from moving relative to each other. The width of the sticks 11,12, 25, 26, 27, 28 and the size of the slots 21 are close enough so that the sticks 11,12, 25, 26, 27, 28 being inserted into each others' slots 21 locks the sticks together securely, requiring conscious effort from a human to pull them apart. As can be seen with reference to FIG. 6A, the sticks can be pressed together using two human thumbs 29, which can apply enough force to press the sticks into tight-fitting slots 21. Applying pressure by the two thumbs 29 to different points of the sticks helps to avoid breaking the sticks. While sticks 11, 12 are shown with reference to FIG. 7A, sticks of other size can similarly be coupled, and racks of other sizes can be similarly constructed.

Once one lattice 13, 14 is completed, the lattice 13, 14 is laid out on a hard surface and risers 15 are attached to the lattice at each of the stick coupling 18 (step 42). As shown with reference to FIG. 7C, the risers 15 are attached to the lattice 13, 14 by sliding them at an angle, with the cross-shaped slot 30 on the riser's end being slid onto one of the couplings 18 and the surrounding portions of the sticks 11,12, 25, 26, 27, 28. As the fit between the four appendages 22 and the coupling 18 (as well as proximate portions of the sticks 11,12, 25, 26, 27, 28 that come into contact with the riser 15) is tight, each riser 15 is securely attached to the lattice 13, 14 and a conscious human effort is required to pull them apart. While the risers 15 can be attached to the lattice 13, 14 in any order, in one embodiment, the first riser 15 is attached to the center of the lattice 13, 14, and other risers 15 are added subsequently.

Once the risers 15 are attached to the lattice 13, 14, a first set of sticks 11,12, 25, 26, 27, 28 is inserted into the cross-shaped slots 30 on the end of all of the risers 15 opposite to the end that is attached to the lattice 13, 14 (step 43). When inserted, one of the slots 21 of each of the sticks 11,12, 25, 26, 27, 28 is located within the cross-shaped slot 30 of each of the risers 15, with all of the slots 21 facing upwards. As shown with reference to FIG. 7D, each of the sticks 11,12, 25, 26, 27, 28 is inserted into cross-shaped slots 30 of multiple risers 15, with the number of risers 15 into which a stick 11,12, 25, 26, 27, 28 is inserted being equal to the number of the slots 21 in that stick.

After the first step of sticks 11,12, 25, 26, 27, 28 is inserted into the risers 15, a second set of sticks is inserted into the cross-shaped slots 30 of the risers perpendicularly to the first set of sticks, thus completing the second lattice 13, 14 (step 44). As can be seen with reference to FIG. 7E, the slots of the second set of sticks 11,12, 25, 26, 27, 28 are facing downwards, with one of the slots 21 being inserted into the cross-shaped slot 30 of each of the risers. As the slots 21 of the first set of sticks 11,12, 25, 26, 27, 28 face upwards and the slots of the second set of sticks face downwards, when the slots 21 of both sets of sticks 11,12, 25, 26, 27, 28 are inserted into the cross-shaped slots 30 of the risers, the slots 21 form the couplings 18 in the same way as described above.

Optionally, a base 24 is attached to ends 17 of some of the sticks 11,12, 25, 26, 27, 28 to impart more stability to the rack 10, ending the method 40 (step 45).

While the invention has been particularly shown and described as referenced to the embodiments thereof, those skilled in the art will understand that the foregoing and other changes in form and detail may be made therein without departing from the spirit and scope of the invention.

What is claimed is:

1. A beverage rack assembly, comprising:

a first lattice comprising a plurality of first sticks, each of the plurality of first sticks comprising at least two slots, wherein each of the slots of each of the first sticks in the first lattice is coupled to one of the slots in another one of the first sticks in the first lattice;

a second lattice comprising a plurality of second sticks, each of the second sticks comprising at least two slots, wherein each slot of each of the second sticks in the second lattice is coupled to one of the slots in another one of the second sticks in the second lattice; and a plurality of risers each comprising two ends, each of the ends of each riser comprising four appendages and an X-shaped slot configured to receive overlapping portions of two corresponding first sticks where corresponding slots of the two corresponding first sticks engage each other or overlapping portions of two corresponding second sticks where corresponding slots of the two corresponding second sticks engage each other, wherein each of the risers removably attaches to the first lattice and to the second lattice by the two ends of each riser respectively, wherein the first lattice, the second lattice, and the risers define at least one diamond shaped compartment into which at least one beverage bottle can be placed, wherein a bottom portion of the first lattice and a bottom portion of the second lattice are configured to rest upon a ground surface, wherein the bottom portion of the first lattice forms at least in part one or more first support structures of the first lattice and the bottom portion of the second lattice forms at least in part one or more second support structures of the second lattice, and wherein the first and second support structures support the beverage rack assembly above the ground surface when the first and second support structures are in contact with the ground surface.

2. A beverage rack assembly according to claim 1, wherein the first lattice, the second lattice, and the risers are made of at least one of wood and plastic.

3. A beverage rack assembly according to claim 1, wherein a number of the slots in some of the first sticks differs from a number of the slots in other ones of the first sticks and wherein a quantity of the first sticks is even;

wherein a number of the slots in some of the second sticks differs from a number of the slots in other ones of the second sticks and wherein a quantity of the second sticks is even.

4. A beverage rack assembly according to claim 3, wherein the quantity of the first sticks is equal to the quantity of the second sticks.

5. A beverage rack assembly according to claim 1, wherein the first sticks in the first lattice comprise corresponding first sticks whose number of slots is even and corresponding first sticks whose number of slots is odd;

wherein the second sticks in the second lattice comprise corresponding second sticks whose number of slots is even and corresponding second the sticks whose number of slots is odd.

6. A beverage rack assembly according to claim 1, wherein each of the appendages is triangular prism-shaped.

7. A beverage rack assembly according to claim 1, wherein the first and second support structures maintain a position of the at least one compartment relative to the ground surface.

8. A beverage rack assembly according to claim 7, wherein each of the first sticks comprises at least one end and each of the second sticks comprises at least one end, and wherein a portion of the one or more first support structures of the first lattice and a portion of the one or more second support structures define a base that is attached to at least some of the ends of the first and second sticks respectively.

9. A beverage rack assembly according to claim 1, wherein each compartment is formed by four of the risers.

10. A method of forming a beverage rack assembly, comprising the steps of:

creating a first lattice out of a plurality of first sticks, each of the plurality of first sticks comprising at least two slots;

coupling each of the slots of each of the first sticks in the first lattice to one of the slots in another one of the first sticks in the first lattice;

creating a second lattice out of a plurality of second sticks, each of the second sticks comprising at least two slots;

coupling each slot of each of the second sticks in the second lattice to one of the slots in another one of the second sticks in the second lattice;

providing a plurality of risers each comprising two ends, each of the ends of each riser comprising four appendages and an X-shaped slot configured to receive overlapping portions of two corresponding first sticks where corresponding slots of the two corresponding first sticks engage each other or overlapping portions of two corresponding second sticks where corresponding slots of the two corresponding second sticks engage each other;

attaching each of the risers to the first lattice and to the second lattice by the two ends of each riser respectively, wherein the first lattice, the second lattice, and the risers define at least one diamond shaped compartment into which at least one beverage bottle can be placed, wherein a bottom portion of the first lattice and a bottom portion of the second lattice are configured to rest upon a ground surface, wherein the bottom portion of the first lattice forms at least in part one or more first support structures of the first lattice and the bottom portion of the second lattice forms at least in part one or more second support structures of the second lattice, and wherein the first and second support structures support the beverage rack assembly above the ground surface when the first and second support structures are in contact with the ground surface.

11. A method according to claim 10, wherein the first sticks, the second sticks, and the risers are made of at least one of wood and plastic.

12. A method according to claim 10, wherein a number of the slots in some of the first sticks differs from a number of the slots in other ones of the plurality of the first sticks and wherein a quantity of the first sticks is even;

wherein a number of the slots in some of the second sticks differs from a number of the slots in other ones of the second sticks and wherein a quantity of the second sticks is even.

13. A method according to claim 12, wherein the quantity of the first sticks is equal to the quantity of the second sticks.

14. A method according to claim 12, wherein the first sticks in the first lattice comprise corresponding first sticks whose number of slots is even and corresponding first sticks whose number of slots is odd;

wherein the second sticks in the second lattice comprise corresponding second sticks whose number of slots is even and corresponding second sticks whose number of slots is odd.

15. A method according to claim 10, wherein each of the appendages is triangular prism-shaped.

16. A method according to claim 10, wherein the first and second support structures maintain a position of the at least one compartment relative to the ground surface.

17. A method according to claim 16, further comprising the step of: joining a base to ends of the first and second sticks respectively to form one of the first support structures of the first lattice and one of the second support structures of the second lattice.

* * * * *